United States Patent [19]

Berger

[11] Patent Number: 5,038,969

[45] Date of Patent: Aug. 13, 1991

[54] LID DISPENSER

[76] Inventor: Nelson A. Berger, Box 822, Nanton, Alberta, Canada, T0L 1R0

[21] Appl. No.: 484,872

[22] Filed: Feb. 26, 1990

[51] Int. Cl.[5] ..... B65H 3/00

[52] U.S. Cl. ..... 221/40; 221/191; 221/195; 221/270; 221/276

[58] Field of Search ..... 221/40, 191, 195, 240, 221/259, 261, 268, 270, 272, 274, 276

[56] References Cited

U.S. PATENT DOCUMENTS

| | | | |
|---|---|---|---|
| 1,170,705 | 2/1916 | Swift | 221/40 |
| 3,263,860 | 8/1966 | Haas | 221/195 X |
| 3,558,006 | 1/1971 | Redmond et al. | 221/274 X |
| 3,784,057 | 1/1974 | Tuttle | 221/274 X |
| 4,949,526 | 8/1990 | Brogna et al. | 221/240 X |

FOREIGN PATENT DOCUMENTS

| | | | |
|---|---|---|---|
| 0211552 | 7/1909 | Fed. Rep. of Germany | 221/195 |
| 0470704 | 6/1914 | France | 221/195 |
| 0356785 | 2/1938 | Italy | 221/274 |

*Primary Examiner*—Robert P. Olszewski
*Assistant Examiner*—Tuan N. Nguyen
*Attorney, Agent, or Firm*—George Haining Dunsmuir

[57] ABSTRACT

The normal practice in serve yourself coffee outlets, such as cafeteria-style restaurants and some convenience stores, is to provide loose lids in a cardboard box. A common result is that lids are knocked on the floor and spread around so that different sizes of lids become mixed together. A simple solution to the problem is a lid dispenser which dispenses lids one at a time when a lever is pressed downwardly. The lever extends through the front wall of the dispenser for actuating a pusher arm which engages the flange of the lowermost lid of a stack of lids and pushes the lid through a slot in the dispenser housing. A helical spring returns the lever and the pusher arm to the rest position in which the arm is suitably located for another lid dispensing operation.

6 Claims, 4 Drawing Sheets

LID DISPENSER

BACKGROUND OF THE INVENTION

This invention relates to an apparatus for dispensing container lids, and in particular to an apparatus for dispensing lids of the type including a circular top wall and a downwardly extending annular flange integral with the top wall.

It will be appreciated that lids of the type described above are commonly referred to as coffee cup lids. Such lids are used with styrofoam or hard plastic cups in cafeteria style restaurants and other establishments of the type which sell take-out coffee or tea. The usual practice is to remove the cover from the cardboard container carrying the lids, i.e. to leave the lids loose in the container. Quite often, the lids get mixed with lids of different sizes or are difficult to separate, i.e. the lids become jammed together.

Lid dispensers have been proposed, for example, by U.S. Pat. Nos. 3,313,452, issued to J. Katz on Apr. 11, 1967 and 4,257,532, issued to C. M. Berg. The mere fact that the patented devices do not appear to be available to the public, strongly suggests that they do not offer satisfactory solutions to the problem of lid dispensing.

The object of the present invention is to provide a solution for the above defined problem in the form of a relatively simple mechanical lid dispenser, which dispenses lids of the coffee cup type one at a time.

BRIEF SUMMARY OF THE INVENTION

Accordingly, the present invention relates to an apparatus for dispensing container lids of the type including a circular top wall and a downwardly extending annular flange comprising housing means; partition means dividing the interior of said housing means into an upper storage chamber for receiving and storing a stack of lids and a lower dispenser chamber; dispensing slot means in said housing means at the lower end of said storage chamber; dispenser means in said dispenser chamber for dispensing lids one at a time through said slot means, said dispenser means including lever means pivotally mounted in said dispenser chamber and extending out of said dispenser chamber for manual actuation; arm means in said casing means carried by said lever means normally extending upwardly, through said partition means into the area bordered by the flange of the lowermost lid in the stack; and spring means normally biasing said lever means and said arm means to a rest position in the housing means, whereby, when the lever means is manually actuated, the arm means pushes a lid through said slot means, and then returns said spring means, said lever means and arm means to the rest position ready for another dispensing operation.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT(S)

Figure 1:
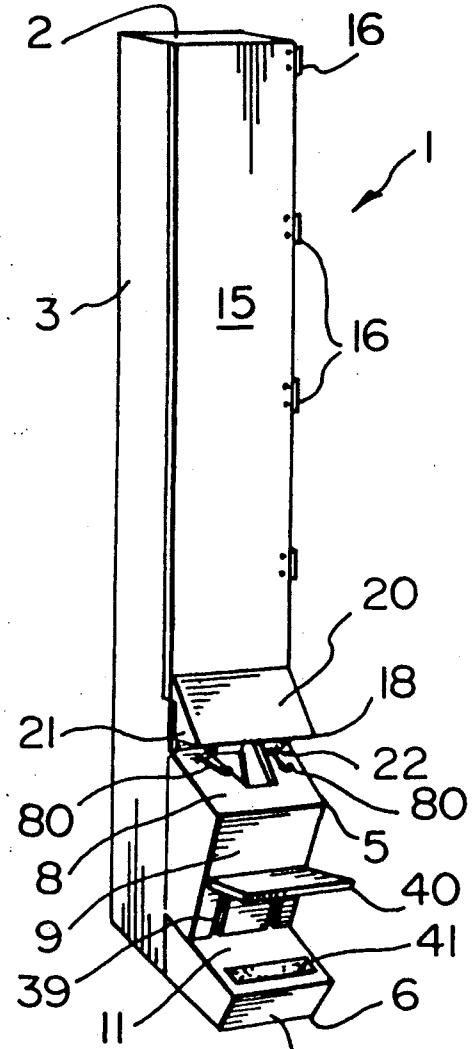
FIG. 1 is a schematic, isometric view of a lid dispenser in accordance with the present invention.

With reference to FIG. 1, the lid dispenser of the present invention includes an elongated housing generally indicated at 1 which is defined by a top wall 2, side walls 3, a rear wall 4, a front wall 5 and a base 6. The front wall 5, which includes a downwardly and outwardly inclined ledge 8 and a downwardly and inwardly inclined lower portion 9, closes only the bottom portion of the otherwise open front end of the housing 1. The base 6 also includes an inclined ledge 11 extending outwardly from the bottom end of the wall 5, and a lower front wall 12. A rectangular bottom wall 14 (FIGS. 3 and 4) completes the base 6.

The remainder of the front of the casing 1 is closed by a door 15 connected by hinges 16 to one side wall 3. An overhang 18 defined by an inclined front panel 20 and triangular ends 21 is provided on the bottom end of the door for limiting access to a slot 22 through which lids 24 are discharged. The lids 24 are stored in the housing 1 on the ledge 8, which extends through the opening 22 into the housing 1. The ledge 8 has a generally inverted V-shape, including a rearwardly and downwardly inclined rear portion 25 for supporting a stack of lids 24. The ledge 8 defines a partition dividing the interior of the casing 1 into an upper lid storage chamber 27 and a lower dispenser chamber 28 housing a lid discharge mechanism generally indicated at 30.

Figure 3:
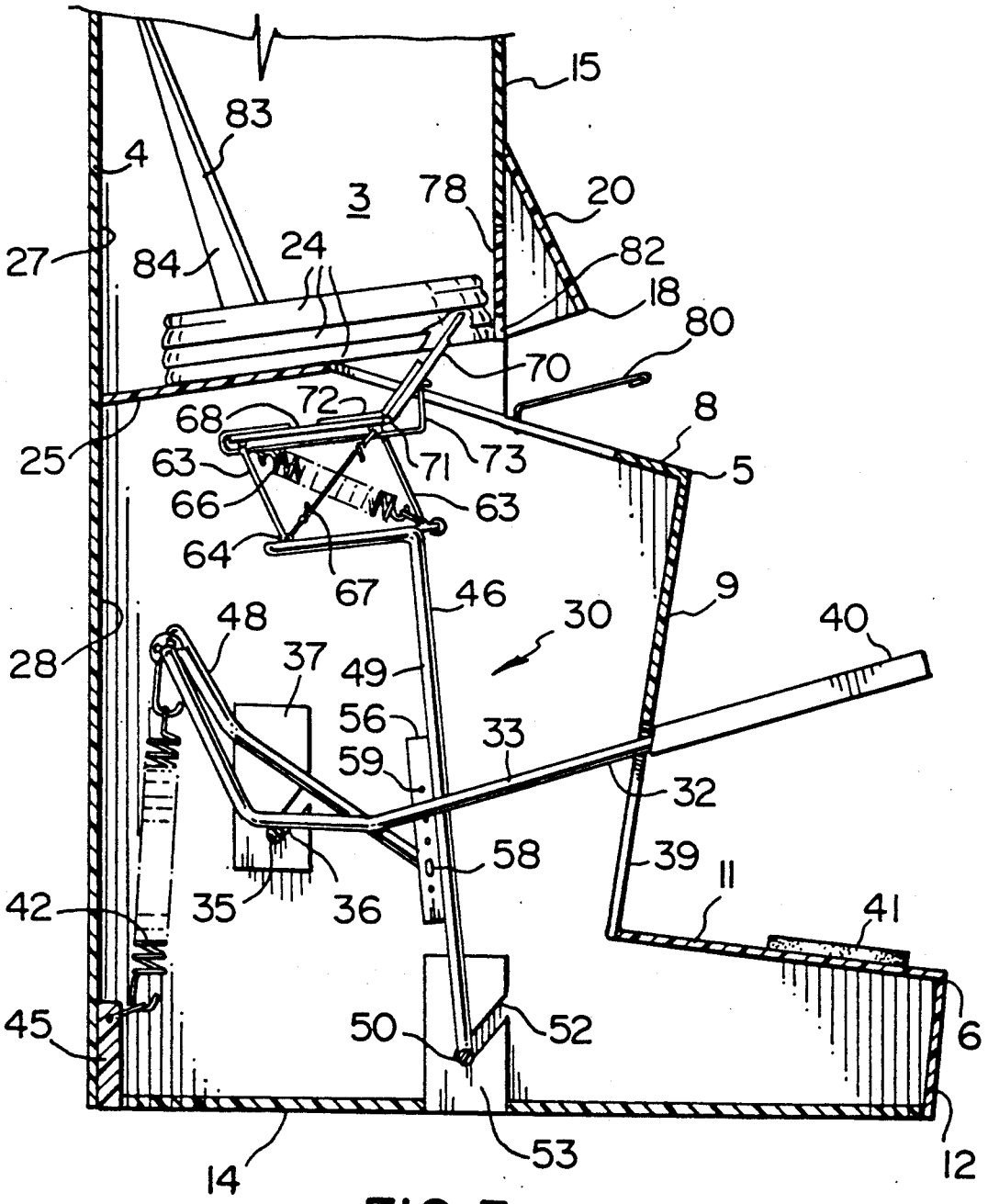
FIGS. 3 and 4 are schematic, longitudinal sectional views of the bottom portion of the apparatus of FIG. 1.
Figure 4:
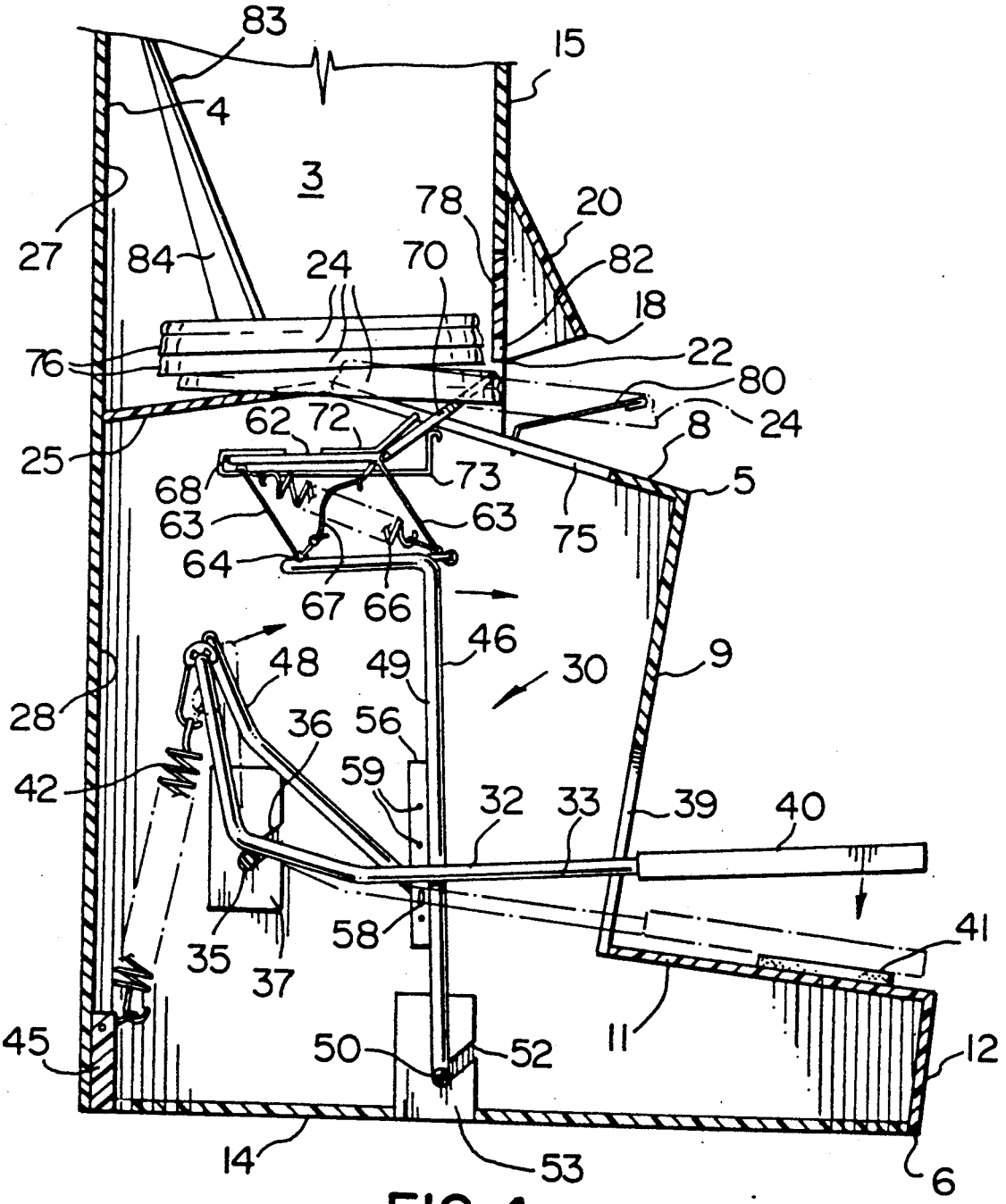
Figure 5:
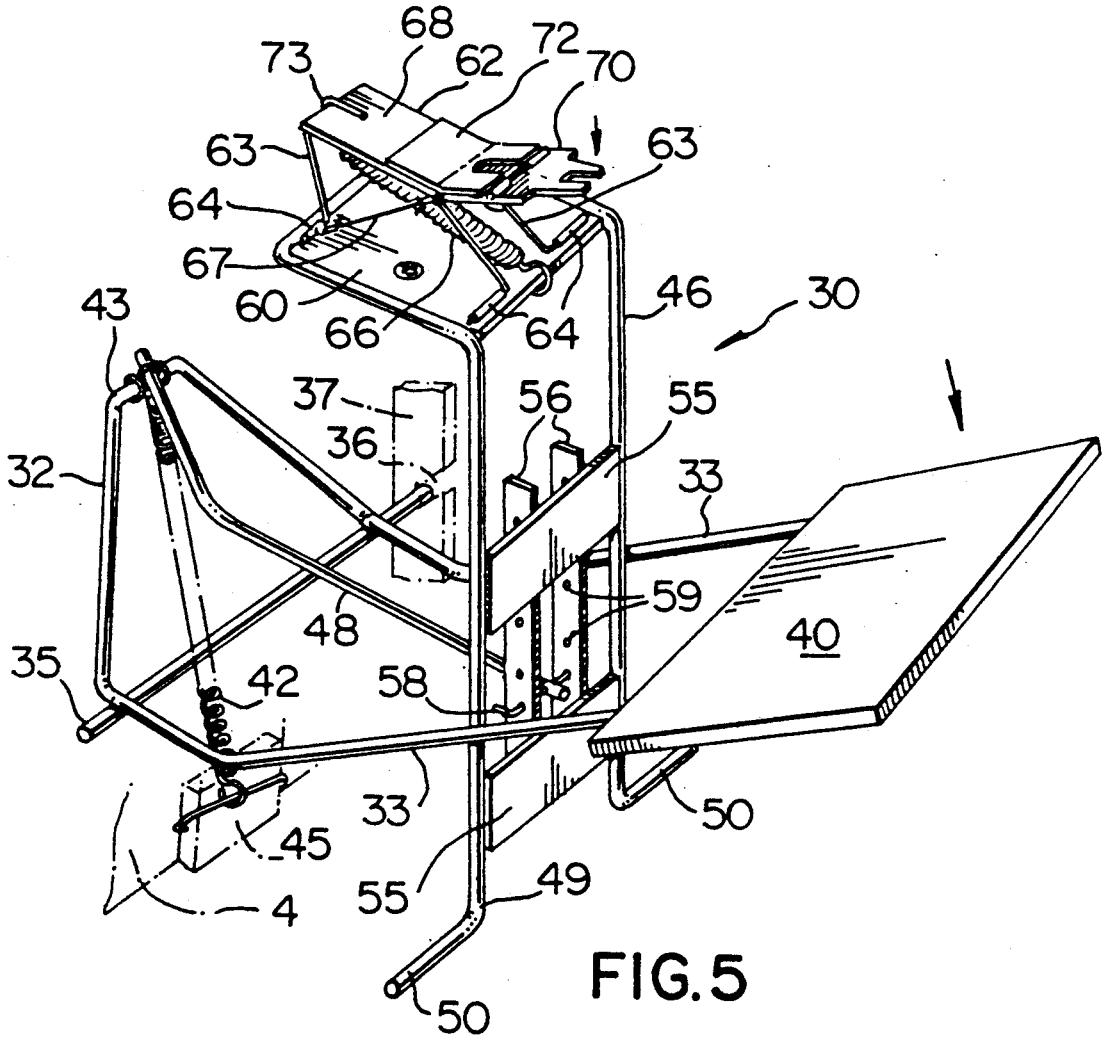
FIG. 5 is a schematic, isometric view of a dispenser mechanism used in the apparatus of FIGS. 1 to 4.

Referring to FIGS. 3 to 5, the lid discharge mechanism 30 includes a lever 32 defined by a single rod, which is bent to define a generally U-shape (when viewed from above) and a L when viewed from the sides. The bottom, inner ends of the arms 33 of the lever 32 are connected to a rod 35, which is pivotally mounted in rearwardly and downwardly inclined notches 36 in plates 37 connected to the bottoms of the housing sides 3. The arms 33 of the lever 32 extend outwardly and upwardly through vertical slots 39 in the front wall portion 9. A rectangular push plate 40 is mounted on the outer ends of the arms 33 so that the lever 32 can be manually rotated around the longitudinal axis of the crossbar 35. A flexible pad 41 is provided on the ledge 11 for preventing damage to the ledge 11. The lever 32 is biased to a rest position in which the outer ends of the arms 32 press upwardly against the top ends of the slots 39 by a helical spring 42, which extends between the inner or bight end 43 of the lever 32 and a block 45 on the bottom centre of the rear wall 4 of the housing 1.

The lever 32 is connected to a second, vertical lever 46 by a rod 48. The lever 46 is defined by an inverted U-shaped rod 49, the bottom ends 50 of which extend outwardly into inclined notches 52 in small blocks 53 on the sides 3 of the housing 1. Thus, the lever 46 is pivotally connected to the sides 3 for rotation around the axis defined by the ends 50. A pair of spaced apart crossbars 55 extend between the arms of the lever 46 for supporting vertical strips 56. An L-shaped pin 58 extends through aligned holes 59 in the strips 56 and through a hole in the front end of the rod 48. A plurality of holes 59 are provided in the strips 56, so that the location of the rod can be changed to adjust the tension of the string 42 on the lever 49. A plate 60 (FIG. 5) extends between the arms of the lever 46 at the top end thereof to define a platform. A lid pusher arm 62 is connected to the plate 60 by a parallelogram linkage. The linkage is defined by a pair of inverted U-shaped rods 63, the outwardly extending bottom ends of which are pivotally mounted in sleeves 64 on the plate 60. Likewise the top end or bright of each rod 63 extends through a sleeve on the bottom of the arm 62. The arm 62 is biased forwardly by a helical spring 66 extending between the front of the plate 60 and the rear of the arm 62. Forward rotation of the arm 62 is limited by a wire 67 extending between the rear of the plate 60 and the middle of the arm 62. The arm 62 is formed of rear plate 68 and front fingers 70, which are pivotally interconnected by a hinge 71. A plate 72 in the form of a shallow V mounted on the plate 68 limits upward movement of the fingers 70. The fingers 70 are biased upwardly against the plate 72 by a generally L-shaped wire spring 73, which is mounted on the rear plate 68. The spring 73 extends around the inner end of the rear plate 68, beneath such plate 68 and forwardly and then upwardly into engagement with the inclined front fingers 70.

As best shown in FIG. 4, the fingers 70 on the arm 62 normally extend upwardly through an opening 75 in the ledge 8 inside of the housing 1 and inside of the annular, downwardly extending flange 76 of the lowermost lid 24. When the plate 40 is pressed downwardly, the lever 32 pivots around the longitudinal axis of the rod 35 against the bias of the spring 42. Rotation of the lever 32 is accompanied by forward movement of the lever 46, which pivots around the aligned horizontal axes of the ends 50, and corresponding movement of the arm 62 to push the lids 24 forwardly. A plate 78 limits forward movement of all but the lowermost lid 24. The fingers 70 push such lowermost lid 24 downwardly and forwardly beneath the plate 78 (FIG. 4—phantom outline). The spring 73 is simultaneously depressed by the lid 24 and the fingers 70 of the arm 62. The lid 24 leaving the housing is guided by a pair of guide arms of wires 80 (FIGS. 1 and 3). If the plate 40 is subjected to a quick depression, a lid is literally thrown out of the housing 1. Thus, it is merely necessary to push the plate 40 and the lever 32 downwardly to move a single lid 24 outwardly to a position where it can be grasped.

Figure 2:
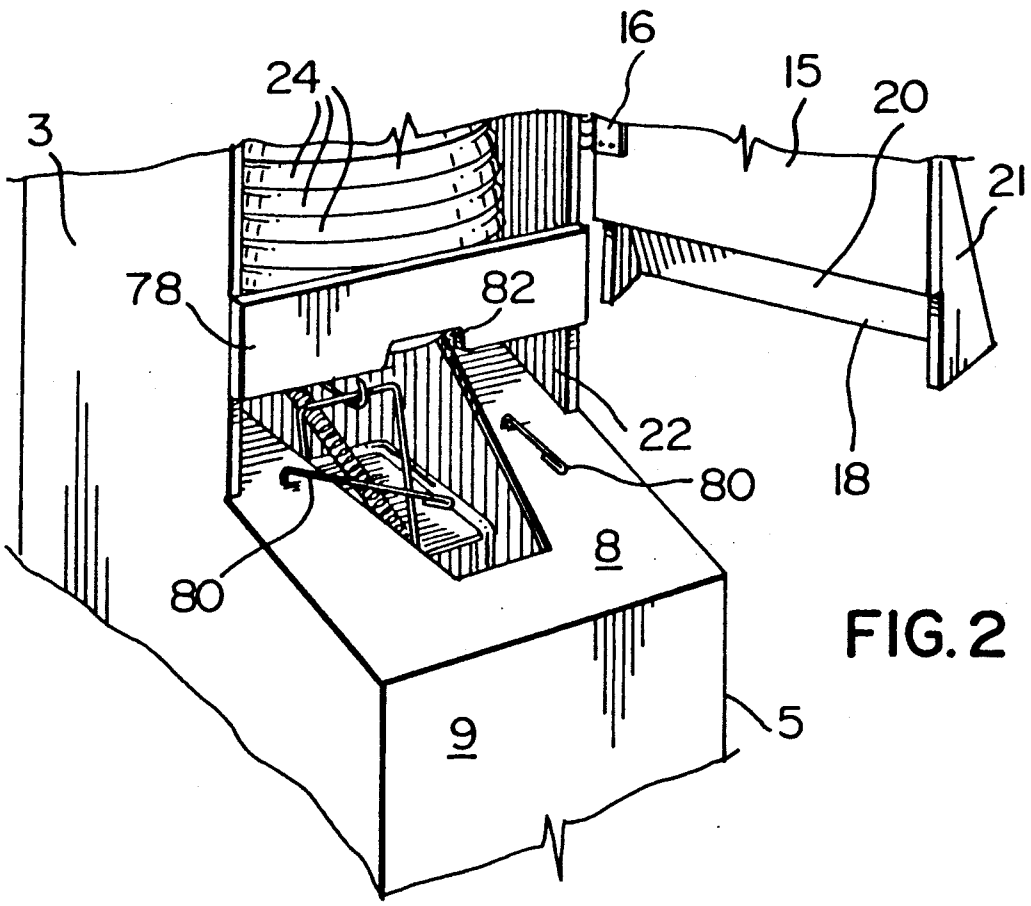
FIG. 2 is a schematic, isometric view of a central portion of the apparatus of FIG. 1 in the open position.

Once a lid has been completely ejected, the wire spring 73 returns the fingers 70 to the rest position and the spring 42 causes the levers 32 and 46 to return to the rest position (FIG. 3). A notch 82 (FIG. 2), is provided in the plate 78 for facilitating return movement of the fingers 70 into the housing 1. The notch 82 also facilitates outward movement of the lid flange 76 during ejection of a lid. Downward movement of the light lids 24 is ensured by the use of a follower 83 (FIGS. 3 and 4) which is merely a strip of material with triangular sides 84 attached thereto. One end of the follower 83 leans against the rear wall 4 on one side of the housing 1, and the bottom end thereof sits on the uppermost lid 24.

What I claim is:

1. An apparatus for dispensing container lids of the type including a circular top wall and a downwardly extending annular flange comprising housing means; partition means dividing the interior of said housing means into an upper storage chamber for receiving and storing a stack of lids and a lower dispenser chamber; dispensing slot means in said housing means at the lower end of said storage chamber; dispenser means in said dispenser chamber for dispensing lids one at a time through said slot means, said dispenser means including lever means pivotally mounted in said dispenser chamber and extending out of said dispenser chamber for manual actuation, said lever means includes a first substantially horizontal lever extending through said housing means for manual rotation around a horizontal axis, and a second, substantially vertical lever connected to said first lever for movement therewith; arm means in said housing means carried by said second means normally extending upwardly through said partition means into the area bordered by the flange of the lowermost lid in the stack; and spring means including a first spring normally biasing said first lever to a rest position and a second spring extending between and said second lever for biasing said arm means into a lid bottom in the rest position in the housing means, whereby when the lever means is manually activated, the arm means pushes a lid through said slot means, and said spring means, said lever means and arm means to the rest position pending for another dispensing operation.

2. An apparatus according to claim 1, wherein said housing means includes an elongated upper section defining said storage chamber; an access opening in one side of said upper section for loading lids into said storage chamber; and door means for closing said access opening.

3. An apparatus according to claim 1, including linkage means connecting said first lever to said second lever, whereby movement of said first lever is transmitted to said second lever.

4. An apparatus according to claim 1, including parallelogram linkage means pivotally connecting said arm means to said second lever, whereby said arm means can be rotated with respect to said second lever means to facilitate passage of a lid through said slot means.

5. An apparatus according to claim 1, wherein said arm means includes plate means pivotally connected to said second lever means, and finger means pivotally connected to said plate means facilitating movement of a lid through said slot means when said arm means is moved by said first and second levers.

6. An apparatus according to claim 5, including third spring means biasing said finger means to a rest position in a lid bottom, and permitting movement of a lid means into said slot means during a dispensing operation.

* * * * *